US007661733B1

(12) United States Patent
Angel

(10) Patent No.: US 7,661,733 B1
(45) Date of Patent: Feb. 16, 2010

(54) DOOR REINFORCING DEVICE

(76) Inventor: Rodger D. Angel, P.O. Box 3273, Warren, OH (US) 44485

( * ) Notice: Subject to any disclaimer, the term of this patent is extended or adjusted under 35 U.S.C. 154(b) by 0 days.

(21) Appl. No.: 12/052,161

(22) Filed: Mar. 20, 2008

(51) Int. Cl.
*E05C 19/00* (2006.01)

(52) U.S. Cl. ..... 292/259 R; 292/260; 292/289

(58) Field of Classification Search ..... 292/259 R, 292/260, 289–297; 70/14, 94, DIG. 63, DIG. 65, 70/DIG. 64
See application file for complete search history.

(56) References Cited

U.S. PATENT DOCUMENTS 1,528,834 A * 3/1925 Leist-Wettler ..... 292/262
3,986,741 A * 10/1976 Giovannini ..... 292/268
5,340,172 A * 8/1994 Sweet ..... 292/259 R
5,364,140 A * 11/1994 Rice ..... 292/259 R
5,826,923 A * 10/1998 Bethurem ..... 292/259 R
5,865,485 A * 2/1999 Lawhorne, Jr. ..... 292/289

* cited by examiner

*Primary Examiner*—Peter M. Cuomo
*Assistant Examiner*—Mark Williams

(57) ABSTRACT

A door reinforcing device includes a pair of first and second spaced-apart plates. A locking device has a center lock, a main lock rod extending from the center lock and engaging the first plate and a retractable lock rod selectively extendable from the center lock and engaging the second plate.

4 Claims, 7 Drawing Sheets

DOOR REINFORCING DEVICE

FIELD

The present disclosure relates to security devices. More particularly, the present disclosure relates to a door reinforcing device which fits on a door to reinforce the structural strength of the door.

BACKGROUND

Residential doors are commonly fitted with a door knob having a locking feature as well as a deadbolt lock. While these features provide a measure of security, they may be indefensible against an intruder ramming or kicking in a door in order to gain access to the interior of the residence. Therefore, a door reinforcing device is needed which is suitable for reinforcing a door of a residence, business or other structure to prevent the door from being kicked in by an intruder.

SUMMARY

The present disclosure is generally directed to a door reinforcing device. An illustrative embodiment of the door reinforcing device includes a pair of first and second spaced-apart plates. A locking device has a center lock, a main lock rod extending from the center lock and engaging the first plate and a retractable lock rod selectively extendable from the center lock and engaging the second plate.

BRIEF DESCRIPTION OF THE DRAWINGS

The disclosure will now be made, by way of example, with reference to the accompanying drawings, in which.

DETAILED DESCRIPTION

Figure 1:
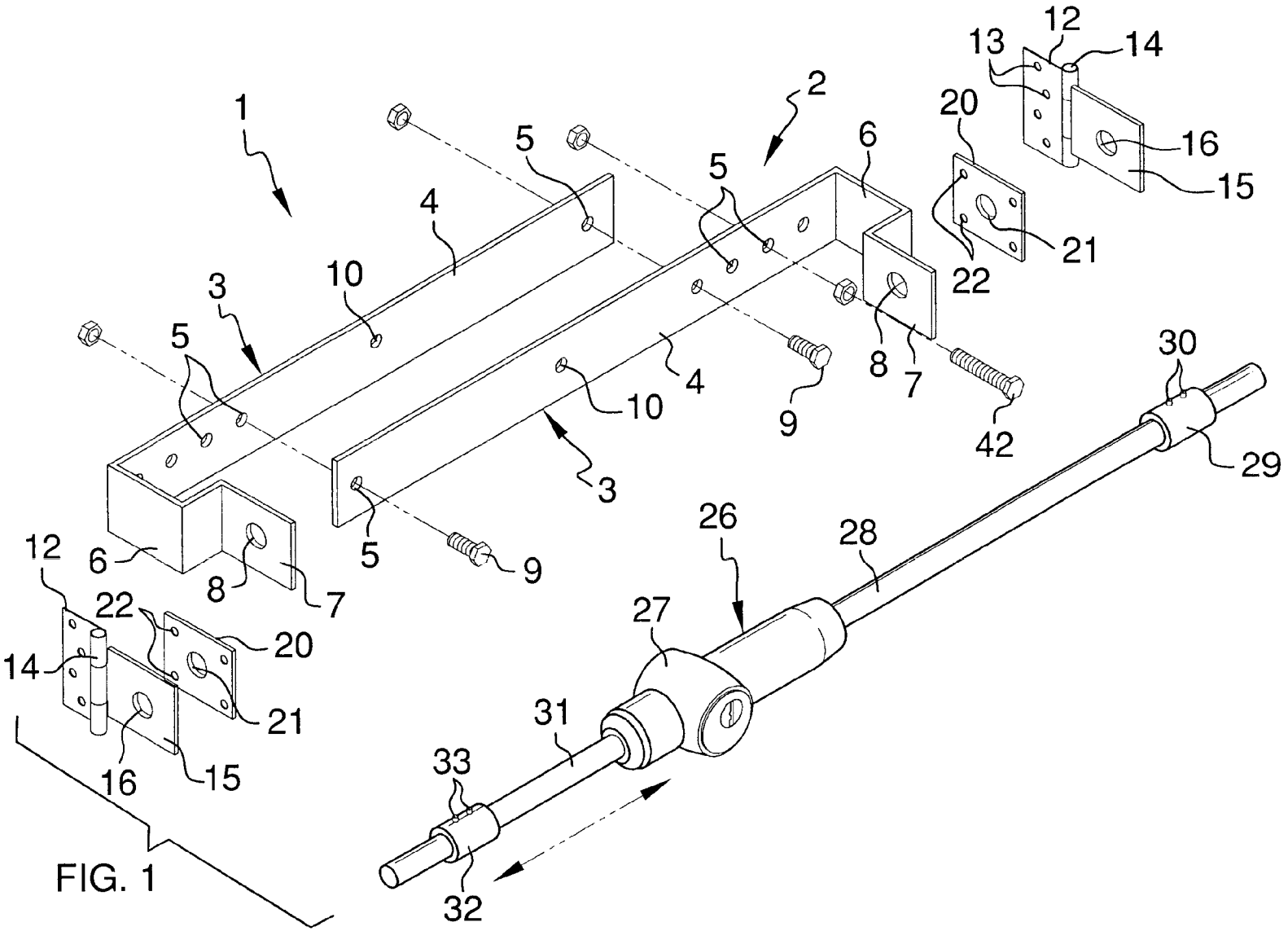
FIG. 1 is an exploded front perspective view of an illustrative embodiment of the door reinforcing device.

Referring initially to FIGS. 1-4A of the drawings, an illustrative embodiment of the door reinforcing device is generally indicated by reference numeral 1. As will be hereinafter described, the door reinforcing device 1 is suitable for reinforcing a door 39 (FIG. 2) which is mounted in a doorframe 38 in a residence, business or other structure. As shown in FIG. 1, the door reinforcing device 1 includes a frame 2 having a pair of frame brackets 3. Each frame bracket 3 includes a generally elongated main bracket segment 4. An offset segment 6 extends from one end of the main bracket segment 4. A frame flange 7 having a rod opening 8 extends from the offset segment 6 of each frame bracket 3.

Figure 4A:
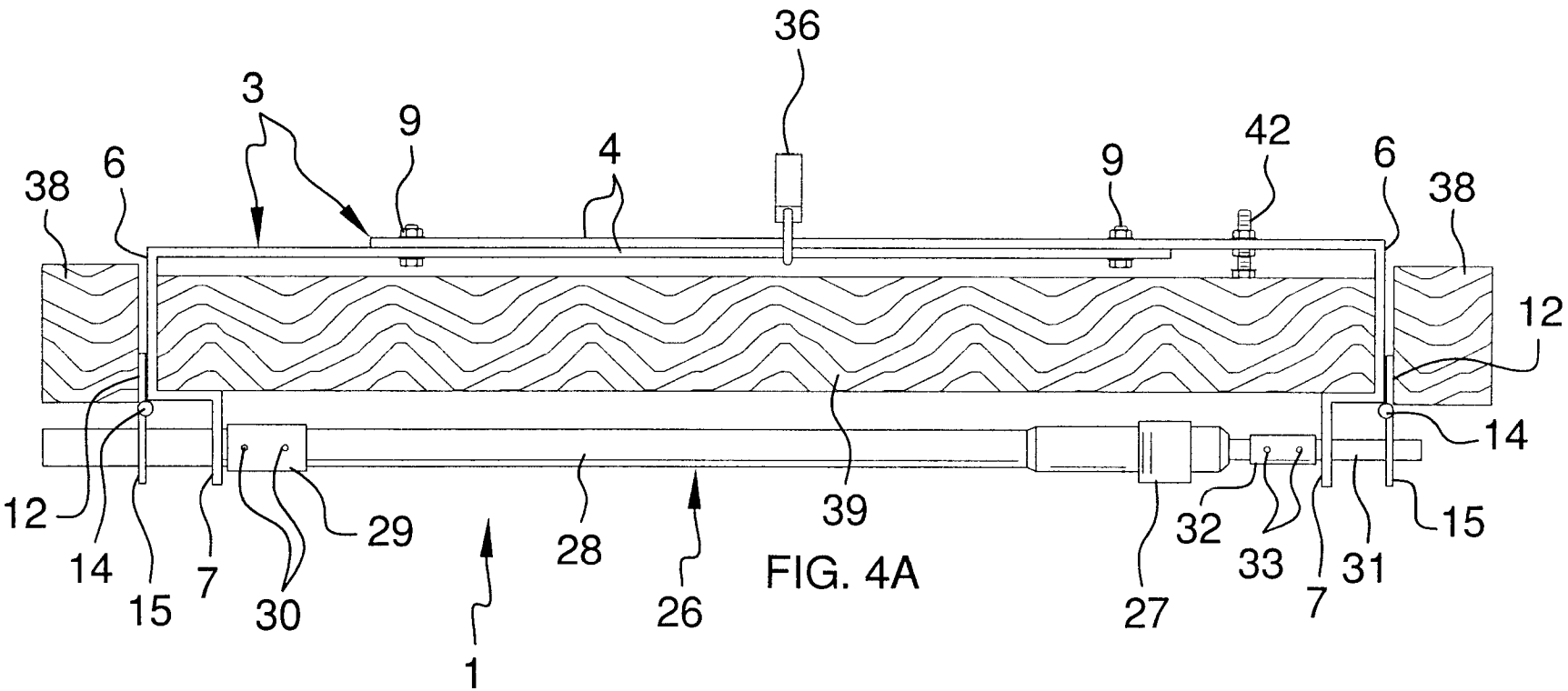
FIG. 4A is a sectional view, taken along section lines 4A-4A in FIG. 3.

As shown in FIG. 4A, in assembly of the frame 2, the overlapping main bracket segments 4 of the frame brackets 3 are attached to each other according to any suitable technique which is known to those skilled in the art. In some embodiments, multiple fastener openings 5 extend through the main bracket segment 4 of each frame bracket 3 for purposes which will be hereinafter described. Frame fasteners 9 are extended through the registering fastener openings 5 in the respective main bracket segments 4 and secured using nuts (not numbered). The offset segments 6 and corresponding frame flanges 7 of the respective frame brackets 3 are located at opposite ends of the frame 2.

A rod plate 15, the purpose of which will be hereinafter described, is adapted for attachment to each side portion of the door frame 38. As shown in FIG. 1, a hinge plate 12 includes multiple fastener openings 13 which receive fasteners (not shown) that are threaded or extended into the door frame 38. The rod plate 15, having a rod opening 16, is pivotally attached to the rod plate 15 via a hinge 14. In some embodiments, a reinforcing plate 20 having a central rod opening 21 may be attached directly to the door frame 38 such as via fasteners (not shown) which are extended through respective fastener openings 22 and threaded or extended into the door frame 38, for example.

A locking device 26 is adapted for extension through the rod opening 8 of each frame flange 7 and the registering rod opening 16 of each rod plate 15. The locking device 26 includes a central lock 27, which may be key-actuated. An elongated main lock rod 28 extends from a first end of the central lock 27. An inside set screw sleeve 29 may be attached to the main lock rod 28 via set screws 30.

A retractable lock rod 31 extends from a second end of the central lock 27 of the locking device 26. The retractable lock rod 31 is extendable and retractable with respect to the central lock 27, as indicated by the double-headed arrow in FIG. 1, according to the knowledge of those skilled in the art. The retractable lock rod 31 can be selectively locked in the extended position with respect to the central lock 27 and unlocked typically by key actuation of the central lock 27. An inside set screw sleeve 32 may be attached to the retractable lock rod 31 via set screws 33.

In typical use, the door reinforcing device 1 is extended around the door 39 and attached to the door frame 38 to secure the door 39 against being rammed or kicked in during an intrusion. Accordingly, as shown in FIG. 4*a*, the offset segments 6 of the respective frame brackets 3 of the frame 2 are placed against opposite edges of the door 39. The main bracket segments 4 of the frame brackets 3 may be attached to each other using the frame fasteners 9. The hinge plates 12 are attached to the respective side portions of the door frame 38.

Figure 2:
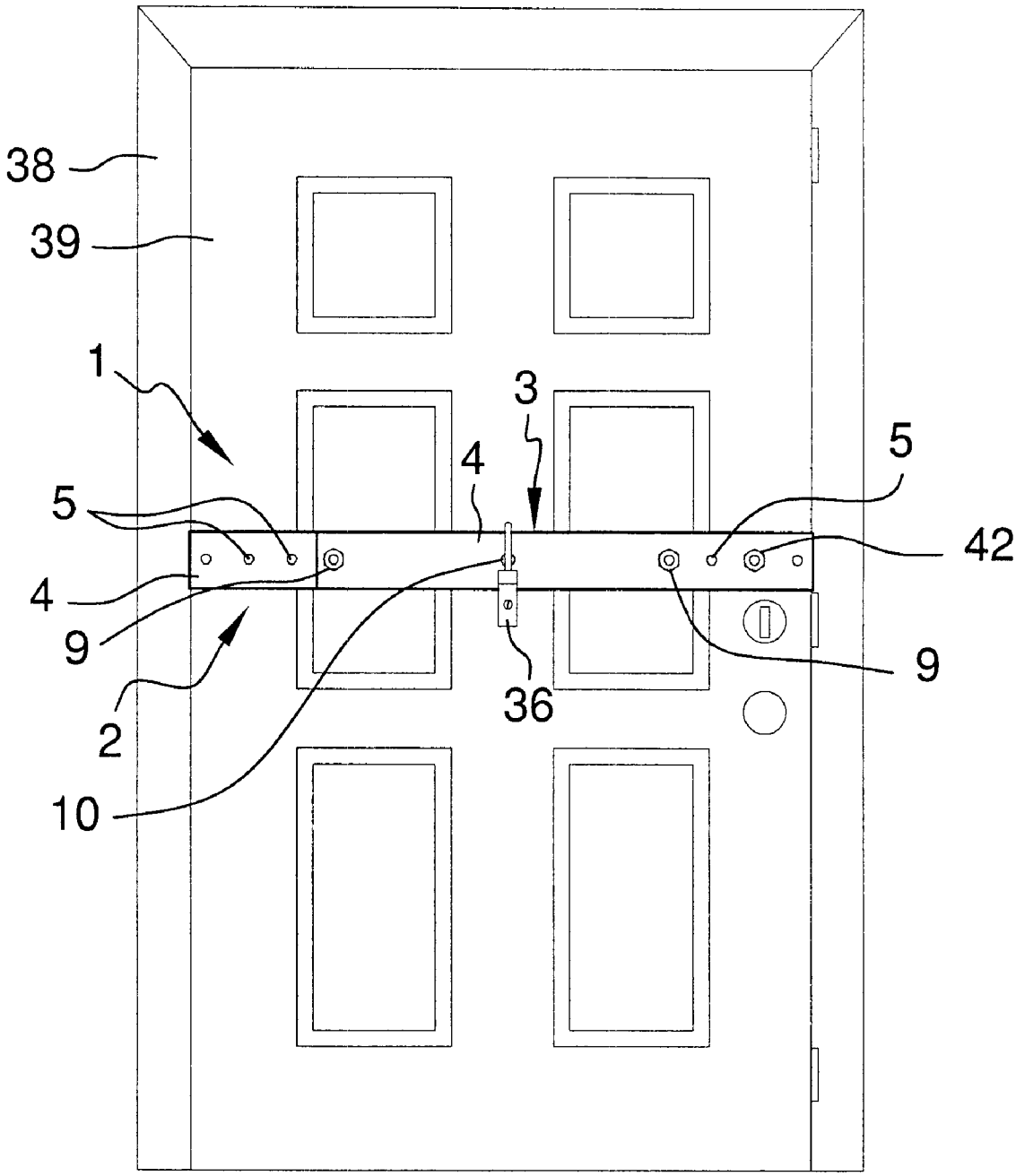
FIG. 2 is a rear view of an illustrative embodiment of the door reinforcing device, with an illustrative embodiment of the door reinforcing device locked in place on a door.
Figure 3:
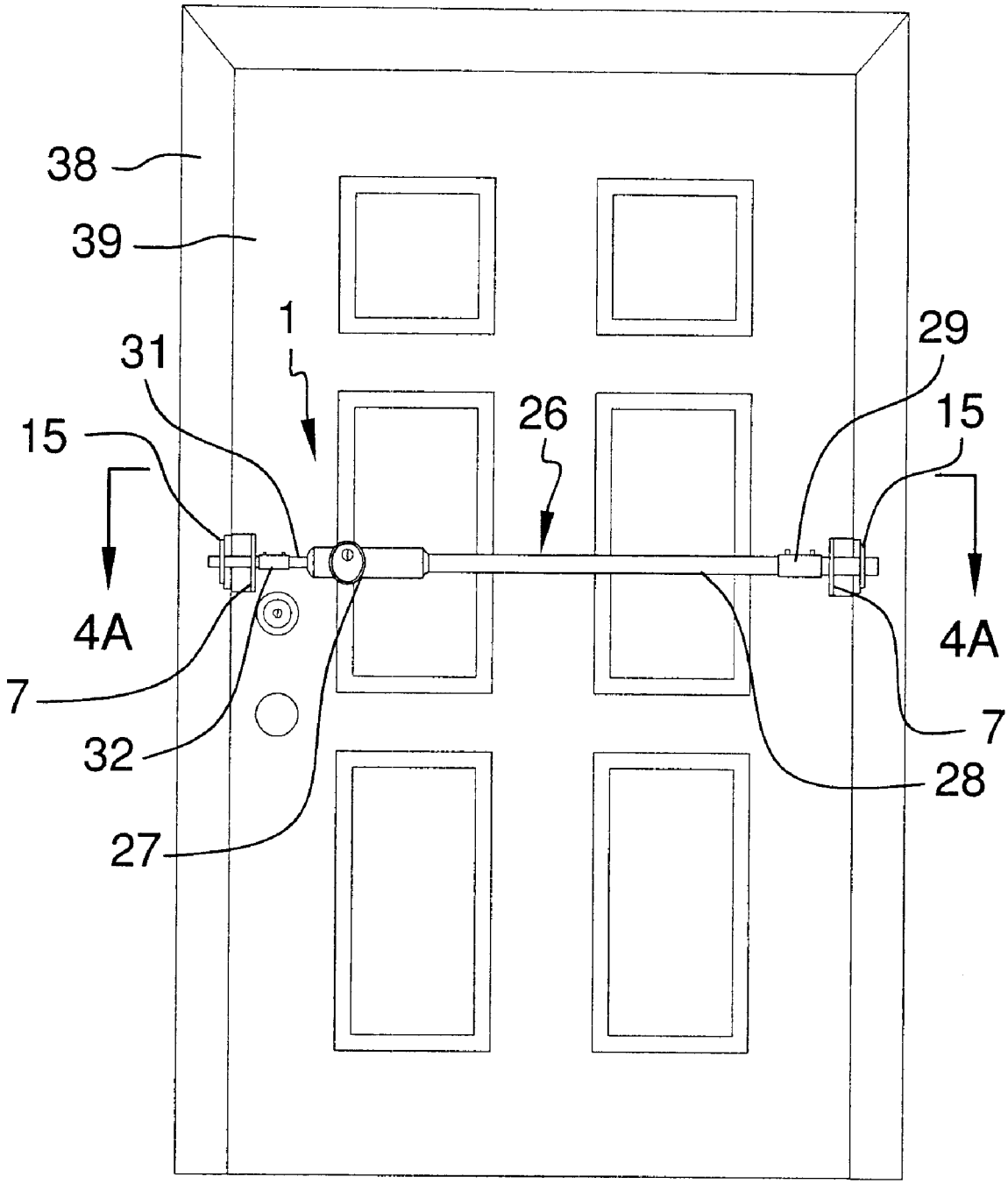
FIG. 3 is a front view of an illustrative embodiment of the door reinforcing device, with an illustrative embodiment of the door reinforcing device locked in place on a door.

The main lock rod 28 of the locking device 26 is inserted through the rod opening 8 of the frame flange 7 and the registering rod opening 16 of the rod plate 15 which are at one end of the frame 2. The retractable lock rod 31 of the locking device 26 is adapted for extension through the rod opening 8 of the frame flange 7 and the registering rod opening 16 of the rod plate 15 which are at the opposite end of the frame 2. The retractable lock rod 31 is locked in the extended position with respect to the central lock 27 of the locking device 26. Accordingly, as shown in FIGS. 3 and 4A, the inside set screw sleeve 29 on the main lock rod 28 may engage the frame flange 7 at one end of the frame 2 whereas the inside set screw sleeve 32 on the retractable lock rod 31 may engage the frame flange 7 at the opposite end of the frame 2. When the door reinforcing device 1 is locked in place on the door 39, the frame 2 may be positioned on the inside and the locking device 26 may be positioned on the outside of the door 39;

alternatively, the frame 2 may be positioned on the outside and the locking device 26 may be positioned on the inside of the door 39. As shown in FIGS. 2 and 4A, a padlock 36 may be extended through registering padlock openings 10 (FIG. 1) provided in the main bracket segments 4 of the respective frame brackets 3 and locked for added security. As shown in FIG. 4A, a spacer bolt 42 may be extended through a pair of registering fastener openings 5 in the main bracket segments 4 of the respective frame brackets 3 and disposed in engagement with the door 39 to space the frame brackets 3 of the frame 2 from the door 39. Accordingly, it will be appreciated by those skilled in the art that the door reinforcing device 1 secures the door 39 to the doorframe 38 and imparts resistance of the door 39 to being rammed open or kicked in during an intrusion. The door reinforcing device 1 may be unsecured by unlocking the central lock 27 of the locking device 26; retracting the retractable lock rod 31 into the locking device 26 and from the corresponding rod plate 15 and frame flange 7; and removing the main lock rod 28 from the corresponding rod plate 15 and frame flange 7.

Figure 4B:
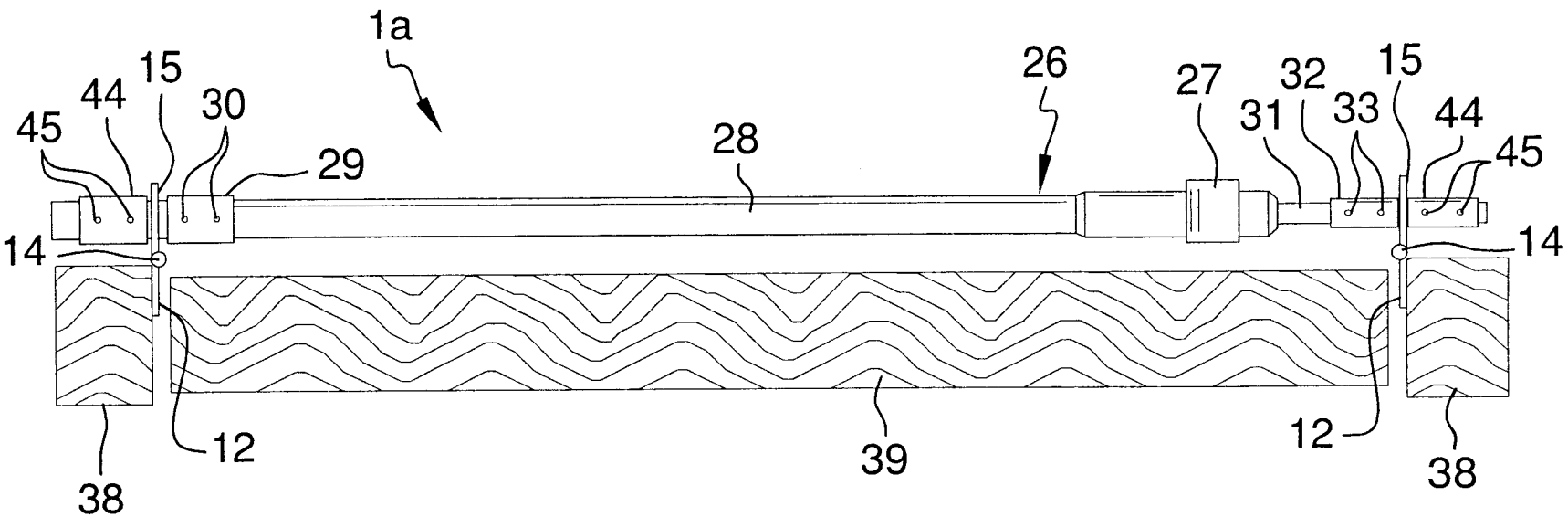
FIG. 4B is a sectional view, taken along section lines 4A-4A in FIG. 3, of an alternative illustrative embodiment of the door reinforcing device.

Referring next to FIG. 4B of the drawings, in an alternative embodiment of the door reinforcing device 1*a*, the frame 2 is omitted. The main lock rod 28 of the locking device 26 is inserted through the rod opening 8 of the frame flange 7 and the registering rod opening 16 of the rod plate 15 on one side of the door frame 38. The retractable lock rod 31 is extended from the central lock 27 of the locking device 26 and inserted through the rod opening 8 of the frame flange 7 and the registering rod opening 16 of the rod plate 15 on the opposite side of the door frame 38. An outside set screw sleeve 44, secured by set screws 45, may be provided on the main lock rod 28 and the retractable lock rod 31, respectively, outside the corresponding rod plate 15.

Figure 4C:
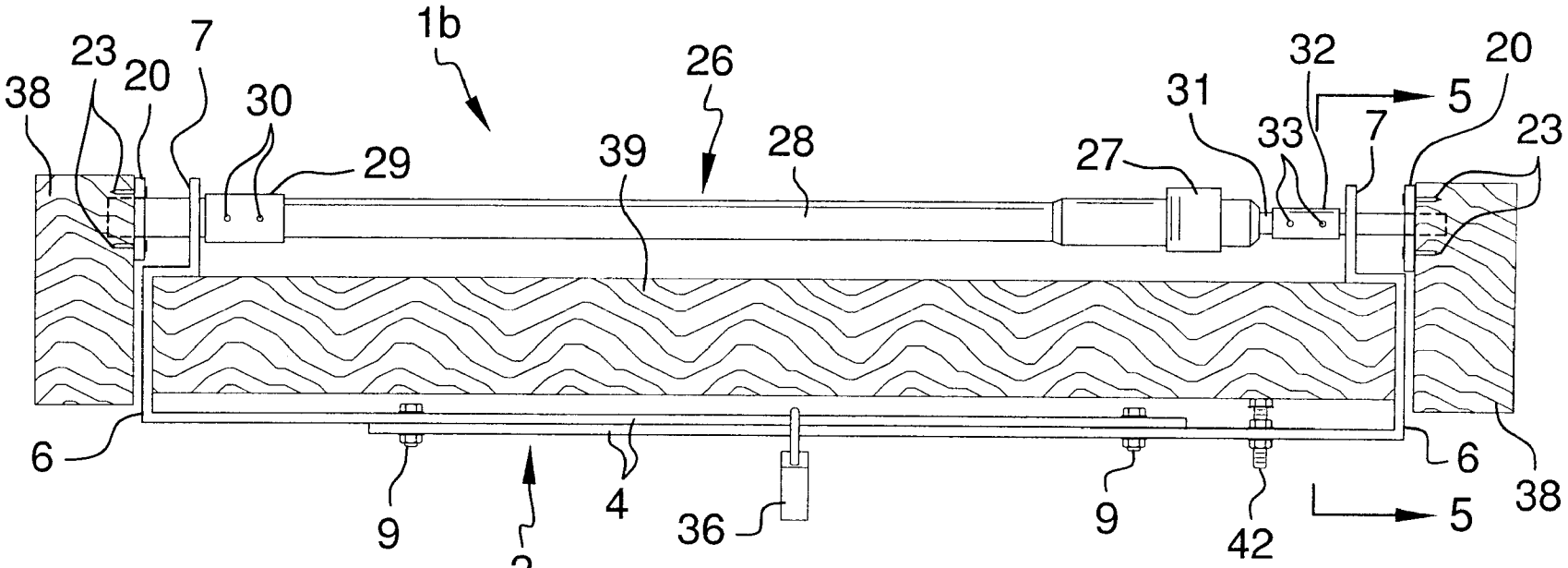
FIG. 4C is a sectional view, taken along section lines 4A-4A in FIG. 3, of another alternative illustrative embodiment of the door reinforcing device.
Figure 5:
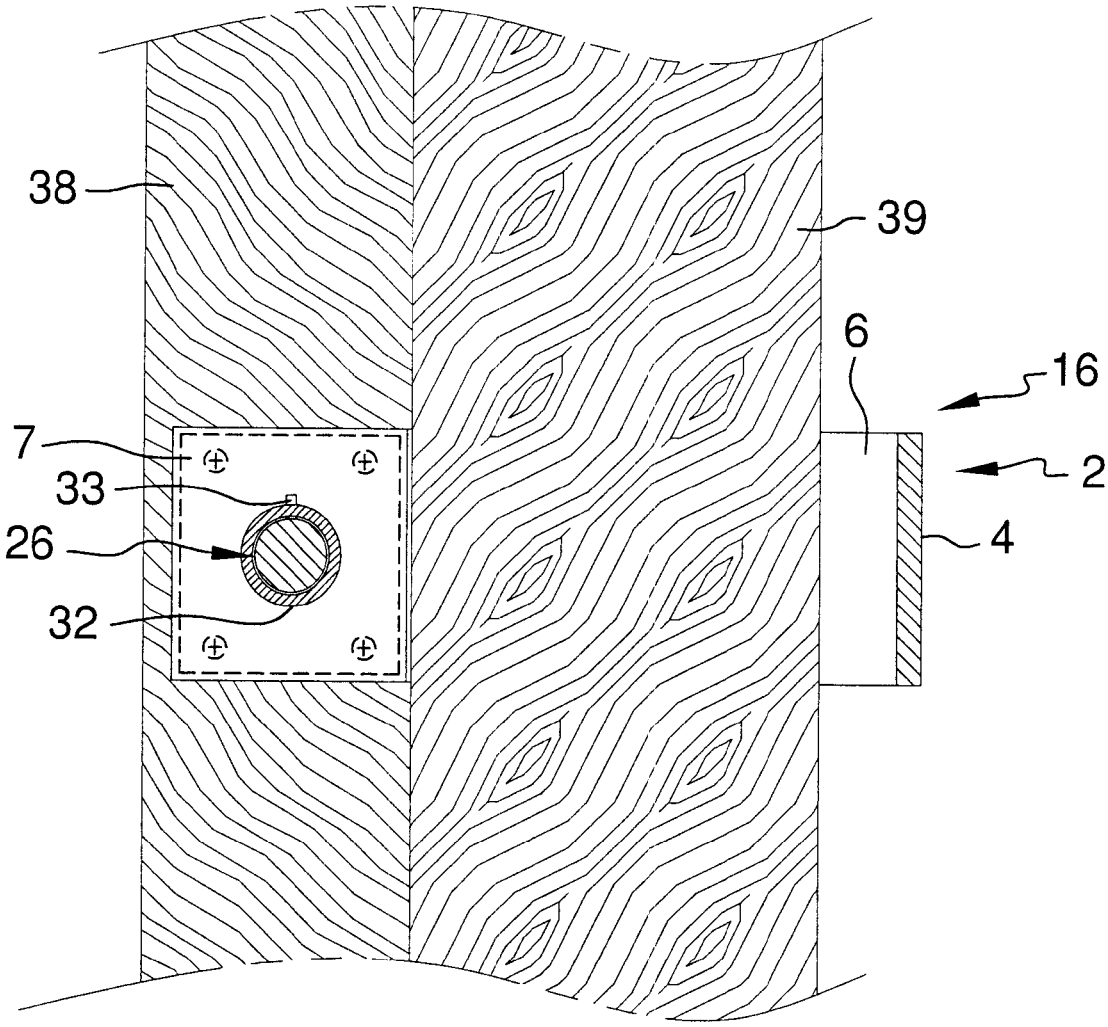
FIG. 5 is a sectional view, taken along section lines 5-5 in FIG. 4C.

Referring next to FIGS. 4C and 5 of the drawings, in another illustrative embodiment of the door reinforcing device 1*b*, the hinge plate 12; hinge 14; and rod plate 15 are omitted from each side portion of the door frame 38. Each reinforcing plate 20 is secured directly to the corresponding side portion of the door frame 38 such as by extending fasteners 23 through the fastener openings 22 (FIG. 1) in each reinforcing plate 20 and threading or extending the fasteners 23 into the door frame 38. The main lock rod 28 of the locking device 26 is extended through the rod opening 8 of the frame flange 7 and the registering rod opening 21 of the reinforcing plate 20 at one side portion of the door frame 38, whereas the retractable lock rod 31 of the locking device 26 is extended through the rod opening 8 of the frame flange 7 and the registering rod opening 21 of the reinforcing plate 20 at the opposite side portion of the door frame 38.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A door reinforcing device, comprising:

a frame having a pair of first and second spaced-apart frame flanges; said frame comprises a pair of overlapping first and second frame brackets attached to each other and wherein said first and second frame flanges are provided on said first and second frame brackets, respectively; said first frame bracket comprises a first generally elongated main bracket segment and a first offset segment extending from said first main bracket segment and said second frame bracket comprises a second generally elongated main bracket segment and a second offset segment extending from said second main bracket segment, and wherein said first frame flange extends from said first offset segment and said second frame flange extends from said second offset segment;

a pair of first and second spaced-apart plates disposed generally adjacent to said first and second frame flanges, respectively; and a locking device having a center lock, a main lock rod extending from said center lock and engaging said first frame flange and said first plate and a retractable lock rod selectively extendable from said center lock and engaging said second frame flange and said second plate.

2. The door reinforcing device of claim 1 wherein said first plate comprises a first reinforcing plate having a first rod opening receiving said main lock rod and said second plate comprises a second reinforcing plate having a second rod opening receiving said retractable lock rod.

3. The door reinforcing device of claim 1 further comprising first and second hinge plates and wherein said first plate and said second plate are pivotally attached to said first hinge plate and said second hinge plate, respectively.

4. The door reinforcing device of claim 1 further comprising at least one set screw sleeve carried by said main lock rod and at least one set screw sleeve carried by said retractable lock rod of said locking device.

* * * * *